United States Patent [19]

Gritters et al.

[11] Patent Number: 4,564,298

[45] Date of Patent: Jan. 14, 1986

[54] HYDROFOIL INJECTION NOZZLE

[75] Inventors: Gregory A. Gritters, Indio; Walter E. Nellis, Bermuda Dunes; John L. Featherstone, El Centro, all of Calif.

[73] Assignee: Union Oil Company of California, Los Angeles, Calif.

[21] Appl. No.: 610,323

[22] Filed: May 15, 1984

[51] Int. Cl.[4] ..... B01F 15/02

[52] U.S. Cl. ..... 366/167; 137/896

[58] Field of Search ..... 366/167, 173, 177, 178, 366/179, 183, 336, 341, 349; 137/896, 897, 898

[56] References Cited

U.S. PATENT DOCUMENTS

| | | | |
|---|---|---|---|
| 1,124,579 | 1/1915 | Ambursen . | |
| 1,529,688 | 3/1925 | Campbell | 366/173 |
| 2,021,092 | 11/1935 | Teliet | 366/174 |
| 2,153,938 | 4/1939 | Reed . | |
| 2,461,797 | 2/1949 | Zwicky . | |
| 2,681,216 | 6/1954 | Knecht . | |
| 3,295,838 | 1/1967 | Ban | 366/167 |
| 3,297,305 | 1/1967 | Walden . | |
| 3,886,973 | 6/1975 | Kinney . | |
| 4,026,527 | 5/1977 | Costen . | |
| 4,114,195 | 9/1978 | Dirksing . | |
| 4,264,212 | 4/1981 | Tookey . | |

*Primary Examiner*—Robert W. Jenkins

*Attorney, Agent, or Firm*—June M. Bostich; Gregory F. Wirzbicki; Dean Sandford

[57] ABSTRACT

An injection nozzle especially useful for injecting corrosive acids into geothermal brines and the like comprises a bullet-shaped hydrofoil injection housing, a tubular manifold conduit connected thereto, preferably such that the axis of said manifold conduit and hydrofoil intersect at right angles, and a plurality of injection tubes emanating from said hydrofoil in a direction opposite that of the point of the bullet.

29 Claims, 3 Drawing Figures

HYDROFOIL INJECTION NOZZLE

BACKGROUND OF THE INVENTION

This invention relates to a fluid injector for the introduction, dispersion, and mixing of a first fluid into a second fluid flowing through a conduit. More particularly, this invention relates to a fluid injector for injecting a highly corrosive fluid, such as hydrochloric acid, into a flowing stream maintained at high temperature and pressure, such as a stream of hot geothermal brine, for the purpose of controlling scaling in the brine-handling equipment without the rapid corrosion to the injector and associated conduits usually attendant in the environment of hot acidified brine.

In the course of producing energy from hot geothermal brine streams, it is known to acidify the hot brine to reduce the production of scale in liquid-handling equipment. Because geothermal brines have been confined in reservoir rock at high temperature and pressure for extremely long periods of time, produced brines are super-saturated with scale-forming constituents dissolved from the reservoir rocks. Upon production from the reservoir, the brine undergoes reduction in temperature and pressure sufficient to cause extensive precipitation of scales from the supersaturated liquid, so that the liquid-handling equipment becomes clogged with scale and, over time, can become completely inoperative. Since the deposition of scales is reduced by addition of acid, it is known to acidify brines to control scaling in geothermal liquid-handling equipment. But the acid used to control scaling can attack and severely corrode the injection apparatus and surrounding conduits. Corrosion to the interior of the injector can be minimized by using acid resistant alloys. However, the combination of hot acid and geothermal brine is many times more corrosive to metals than hot acid alone. Contact of acid in hot brine with the exterior of the injector and nearby conduits can result in corrosion so severe as to rapidly destroy liquid handling equipment made from even the most corrosion resistant alloys.

Apparatus used to inject a small fluid stream into a larger fluid stream and to mix the small stream with the larger may depend upon turbulence created by the body of a nozzle in the larger stream. U.S. Pat. No. 4,114,195 to Dirksing et al. discloses an injector having an elongated body, such as a pipe, mounted through an aperture in the side of a larger conduit transversely to the flow of the larger stream therein. An axial bore through the body of the injector permits introduction and mixing into the additive stream within the injector of a small portion of fluid from the large stream before injection into the large fluid stream. The mixture enters the large stream via openings at each end of a small T-shaped extension having connection with the axial bore and is thereby disbursed into the flowing stream. Additional mixing occurs downstream of the conduit as the result of turbulence in the flowing stream caused by presence of the injector.

A hydrofoil-shaped injector may also be used to control the path of the additive once it is introduced into the fluid stream. U.S. Pat. No. 4,026,527 to Costen discloses a hydrofoil-shaped vortex generator which controls dispersion of an effluent into a liquid stream, such as a river. An effluent liquid is ejected through tips extending from the extreme ends of an injector having a T-shaped transverse wing-like member shaped as a hydrofoil. Vortices are created by the hydrofoil at its extreme ends in the flowing stream. The effluents from each tip are entrained in the vortical flow. By selectively positioning the vortex-generator, effluents can be carried away from the mixing point by the vortices without mixing into the stream at large. The strength and duration of the vortical flow will depend upon factors such as the lift coefficient of the hydrofoil and the speed and turbulence of the flowing streams. The hydrofoil generator is particularly useful for carrying the additive away from the point of dispersion without mixing it into the larger flowing stream. This type of hydrofoil geneator, while useful for preventing back-mixing and providing directional flow to the additive, does not disburse the additive in a uniform manner into the fluid stream as would be desired in an injector used to acidify brine. To prevent precipitation of scale from hot brine, the acid must be mixed thoroughly into the brine within a short distance of the point of injection.

U.S. Pat. No. 3,297,305 to Walden combines a static mixing device with an injection nozzle to promote thorough mixing of a chemical into a flowing stream. Disposed within a tubular mixing chamber, such as a conduit containing flow of a large fluid stream, is a plurality of mixing vanes spaced longitudinally within the mixing chamber. Each vane extends radially outward from a central point at an angle sufficient to impart to the larger stream a swirling movement, each mixing vane being arranged to reverse the swirling movement imparted to the flowing stream by the preceding vane. Ahead of the mixing vanes is an injector tube mounted from the side of the conduit which extends transversely as far as the axial midpoint of the mixing chamber. A laterally extending nozzle directed axially against the intended flow of the larger fluid stream extends from the injector tube. The nozzle is conically shaped and comprises a flexible diaphragm having orifices adapted to deform or stretch in response to increased pressure in the discharge nozzle caused by clogging of dirt or chemical particles. The expandable orifices are self-cleaning, should plugging occur from within. The additive fluid is injected from the nozzle into the flowing stream, and turbulence produced by the vane mixers thoroughly disperses the additive into the larger stream. The nozzle disclosed by Walden, however, is unsuitable for use with a highly corrosive acid. The injected fluid is not disbursed radially away from the nozzle itself to prevent contact of the additive with its exterior. Moreover, since the nozzle injects the additive against the flow of the current, the chemical additive flows across the injection nozzle. If the additive were a highly corrosive acid such as the hydrochloric acid used in control of scale from geothermal brine, the concentrated acid would corrode the exterior of the injection nozzle beyond use in a relatively short period of time.

The problems unique to injection of a highly corrosive scale-inhibiting additive into a high temperature geothermal stream therefore are not solved by injection nozzles known in the art. What is particularly needed is an injection nozzle which disburses the corrosive additive away from the nozzle in a uniform manner. Uniform dispersion directed away from the nozzle assures that the nozzle is not subject to rapid corrosion, and that the additive will effectively reduce scaling in the interior of the conduit without excessive corrosion to the walls of the conduit.

SUMMARY OF THE INVENTION

It has now been discovered that corrosion due to injection of acid into a fluid stream, such as a geothermal brine stream, can be substantially reduced or minimized by introducing the acid into the fluid stream using a nozzle comprising (1) a bullet-shaped hydrofoil injection housing; (2) a tubular manifold conduit connected in fluid-tight arrangement with said housing, said connection preferably being such that the axis of said conduit and the hydrofoil intersect at right angles, and (3) a plurality of injection tubes in fluid communication with said injection housing and emanating from said housing in a direction opposite that of the point of the bullet.

BRIEF DESCRIPTION OF THE DRAWING

The present invention will be more readily understood by reference to the drawings.

It will be understood that like elements in the figures are referred to by the same reference numerals.

DETAILED DESCRIPTION OF THE INVENTION

Figure 1:
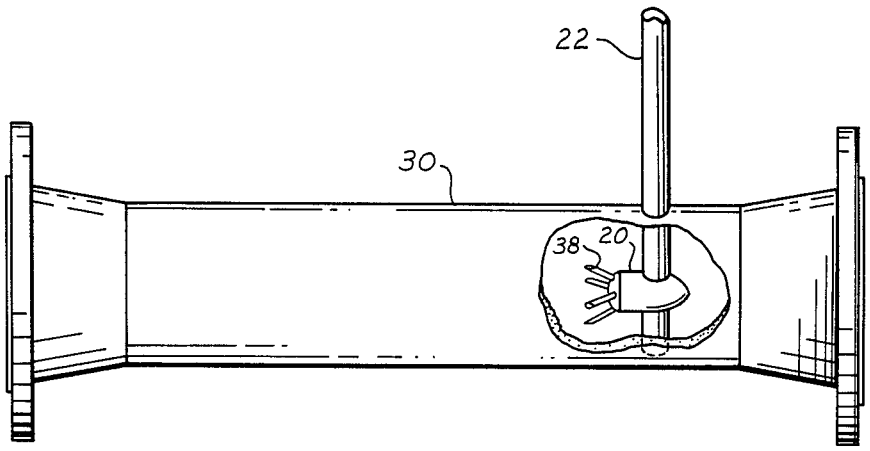
FIG. 1 is an isometric drawing of a conduit having, as shown in a breakaway view, an injection nozzle of the invention positioned therein.

In producing and utilizing hot pressurized brine solutions which contain dissolved salts at or near their saturation concentrations, if the pressure and/or temperature of the solutions is reduced, a portion of the salts can precipitate and deposit as scale on the surfaces of the vessel or conduit confining the brine. To prevent deposition of scales from geothermal brine, hydrochloric acid is commonly used to reduce the pH of the brine sufficiently to prevent scaling. While other strong acids would be somewhat less corrosive to the metals used for conduits and vessels, hydrochloric acid is the least likely of the commonly used and economically feasible acids to contribute anions to scales forming in the geothermal brines. An acid injection nozzle, therefore, for use in geothermal brines must inject the highly corrosive acid while protecting the nozzle from the effects of the acid. To also prevent corrosion to the conduits carrying the acidified stream, the nozzle should be designed so as to limit contact of unmixed acid with the walls of the conduit. Since the injection nozzle disburses the acid upon entry into the stream, corrosion damage to downstream equipment, such as a static mixer and conduits, is minimized while scaling is reduced.

With reference now to the drawing, a bullet-shaped injection housing 20 is shown to comprise a hydrofoil 26, a cylindrical portion 36, and spherical projection 34 mounted in fluid-tight connection with a substantially straight manifold conduit 22. The point of the bullet is directed against the flow in conduit 30. Preferably, extension 32 has no fluid communication with the interior of injection housing 20 but is connected to the exterior thereof and extends across the diameter of conduit 30 so as to hold the bullet-shaped housing suspended with the axis 50 of the hydrofoil colinear with the axis of conduit 30. The combination of manifold conduit 22, injection housing 20, extension 32, and injection tubes 38 preferably presents a symmetrical impedance to the flow of fluid in conduit 30 so that turbulence generated by the hydrofoil will be symmetrical along the axis of conduit 30.

The purpose of the hydrofoil shape for the exterior of injection housing 20 is, in a geothermal application, to minimize turbulence in the brine stream caused by the injection nozzle. Turbulence promotes formation of scale on the nozzle and in the adjacent conduit by imparting kinetic energy to the supersaturated fluid stream. It also causes channelling of acid along the face of the injection nozzle and along the walls of the conduit housing the nozzle, which results in corrosion of the nozzle and/or conduit. In the preferred embodiment, the hydrofoil is shaped so as to cause turubulence at a distance of about twice the diameter of conduit 30 downstream from the point of acid injection. The total cross-sectional area of the hydrofoil injection nozzle, including the tubular arms 38 and the acid manifold 22, as presented against the flow of the brine stream in conduit 30, preferably does not exceed about 20 percent of the inner cross-sectional area of conduit 30 taken on a plane normal to its axis. The combination of limited cross-sectional area and hydrofoil shape for the injection nozzle is especially effective for minimizing turbulence which might induce channelling of acid by backmixing into the low pressure area upstream of the injection nozzle.

In the preferred embodiment, the cylindrical portion 36 of the bullet-shaped housing opposite its point is joined in a fluid-tight jointure with a projection 34 having the exterior shape of a sphere cut by a plane. The purpose of spherical projection 34 is to minimize backmixing by minimizing the turbulence generated by the hydrofoil. In the most preferred embodiment, the radius of the spherical surface of projection 34 is twice the radius of the cylindrical portion 36 of the hydrofoil.

Acid injection tubes 38 extend from points of jointure with the acid injection manifold 22 through the spherical projection into the fluid stream. Axial bore 40 extends the length of acid manifold 22 and connects in fluid tight bond with axial bores 42 in injection tubes 38, while opening therefrom into the interior of conduit 30. In the preferred embodiment, as shown in the drawing, the axes of injection tubes 38 extend radially from the intersection of axis 50 of the hydrofoil and axis 60 of manifold conduit 22. Also in the preferred embodiment, the injection tubes are of equal length and equal inner diameter, as well as substantially straight. Further, the injection tubes all cut any of a number of planes normal to the axis 50 of the hydrofoil 26 and parallel to axis 60 of manifold conduit 22; i.e., there is at least one plane, normal to the axis of conduit 30, through which all of the injection tubes pass.

Since the velocity profile in a condit drops to zero at the wall, acid caught in slow-moving fluid next to the wall will subject the metal of the conduit to severe corrosion damage. It is, therefore, preferred that the ends of the injection tubes be located so that acid spurting from openings in the injection tubes at a velocity higher than that of the large flowing stream will not approach the walls of conduit 30 and will not be caught in the slow-moving flow along the conduit walls, thus avoiding excessive corrosion thereof.

For best results in the preferred embodiment, which uses four injection tubes, the positioning of the injection tubes 38 should be determined in relation to the distance between their ends and the walls of the conduit housing the nozzle. The body of the acid injection nozzle is preferably located symmetrically with respect to the interior of the conduit. In a preferred embodiment, the four ends of the extending arms form a rectangle, most preferably a square, on a plane normal to the axis of conduit 30, with the center of the square or rectangle being coincident with the axis of conduit 30. In this embodiment, it is highly preferred that the closest distance between the interior surface of the conduit and the end of a radially extending arm 38 be less than the smallest distance between any two ends of the four radially extending arms 38 but greater than 75 percent of that smallest distance.

The downstream angle at which the injection tubes diverge is preferably adjusted to suit the velocity of the fluid flow in conduit 30. At higher fluid velocities, higher angles may be tolerated, typically up to a maximum of about 120 degrees, while at lower velocities, angles down to a minimum of about 20 degrees may be employed.

Although it is not critical to the invention that the injection tubes diverge symmetrically as well as radially from the intersection of axis 50 of the hydrofoil and axis 60 of the manifold, and although it is possible for the injection tubes to diverge in asymmetrical fashion, it is, nevertheless, highly preferred that the injection tubes be arranged symmetrically so that the axes of the tubes lie on the surface of an imaginary right circular cone with the intersection of axis 60 of manifold 22 and axis 50 of the hydrofoil at the apex. As indicated above, the angle of the right circular cone is usually between 20 and 120 degrees. Preferred angles are between about 35 and 70 degrees, and in a most preferred embodiment wherein four injection tubes are employed (as shown in the drawing), the angle of the right circular cone is 60 degrees. (For purposes herein, the angle of divergence is the same as the angle at the apex of the imaginary right circular cone, which is twice the angle any of the axial bores 42 of injection tubes 38 makes against the axis 50 of hydrofoil 26.)

It should be noted that, when injection tubes 38 are arranged symmetrically as described, any plane normal to the axis 50 of hydrofoil 26 and conduit 30 which cuts through injection tubes 38 will intersect the axes of said injection tubes 38 at points which fall on the circumference of a circle concentric with axis 50. Further, said points will divide the circumference into equal arcs; in the preferred embodiment shown in the drawing, the four injection tubes will divide the circumference into 90 degree arcs.

It will be understood that reduction of corrosion through use of the nozzle of the present invention will be dependent upon several factors. One such, as just discussed, is the angle of divergence the several injection tubes 38 make from the injection housing 20. Another is the diameter of conduit 30, another the relation between the velocity and flowrate of fluid in conduit 30 and of the acid injected from injection tubes 38, and still another the length of injection tubes 38. In any particular application, it will be necessary to consider each of these factors and to design the nozzle in a way that will ensure that the acid is injected far enough downstream of the injection housing to prevent corrosion thereof, with the points of injection being sufficiently spaced from the walls of conduit 30 so as to avoid substantial corrosion thereof.

In most embodiments of the invention, it will be found that angles of divergence of 20 to 120 degrees and fluid velocities from the injection tubes between 3 and 5 times the velocity of fluid in conduit 30 will usually prove useful, particularly when the ends of the injection tubes are spaced from the inner wall of conduit 30 by the distances specified hereinbefore.

In operation, the acid injection nozzle of the present invention is used to inject a smaller liquid stream of a highly corrosive strong acid into a larger flowing stream of liquid, such as hot, pressurized geothermal brine, flowing within a cylindrical conduit such as a pipe having a 6-inch diameter or larger. In the preferred embodiment, the acid injection nozzle prevents, minimizes, or substantially reduces corrosion to the exterior of the nozzle by introducing the corrosive acid into the larger stream of brine through a plurality of injection tubes which extend a radially equal distance from a point on the axis 60 of manifold conduit 22, which point is also on the axis 50 of the conduit containing the larger brine stream. The acid enters the stream of hot brine at a velocity greater than that of the brine stream to prevent acid from being trapped into eddy currents that form behind each injection tube. Size and positioning of the injection tubes is determined with reference to the size of the brine conduit and the velocity of the stream into which the additive is injected.

The brine stream then carries the small streams of acid away from their points of entry without backflow of acid upon the exterior of the injection nozzle or along conduit walls due to the turbulence-free design of the injection nozzle. At a point downstream of the injection nozzle, turbulence created by the flowing stream or by use of a conventional static mixer (not shown) uniformly mixes the acid into the brine to accomplish uniform reduction of pH throughout the brine.

EXAMPLE 1

Figure 2:
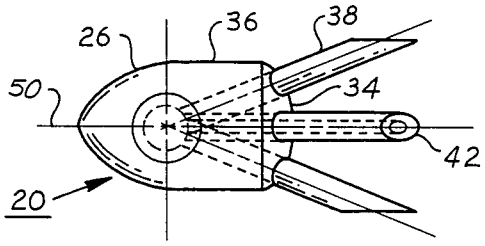
FIG. 2 is a top view of the injection nozzle of FIG. 1.
Figure 3:
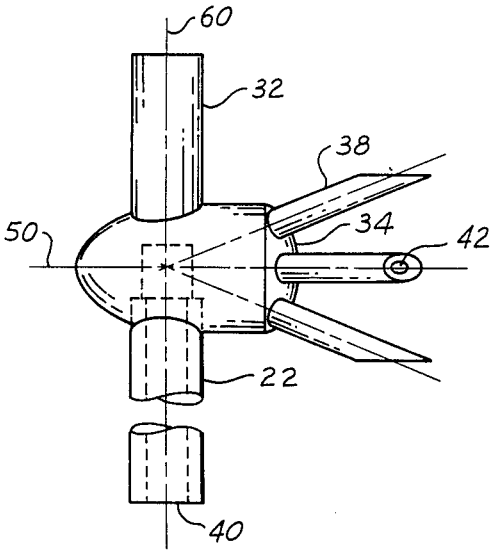
FIG. 3 depicts a side view of the injection nozzle of FIG. 1.

With reference to the hydrofoil injection nozzle shown in FIGS. 1 to 3, an acid injection nozzle is constructed for use in a 10-inch-diameter pipe (of exactly 10.13-inch inner diameter). Cylindrical portion 36 of the hydrofoil has an outside diameter of 2 inches while the overall length of bullet-shaped injection housing 20 is 3 inches and the length from the axis 60 of acid manifold 22 positioned within injection housing 20 to the point of hydrofoil 26 is $1\frac{1}{2}$ inches. The exterior surface of spherical projection housing 20 is twice the diameter of cylindrical portion 36, i.e., 4 inches.

The four acid injection tubes 38 have an outside diameter of $\frac{3}{8}$ inch and extend from their jointure with the injection housing a distance as measured from the axis 60 of manifold 22 to the end of injection tube 38 of 4.5 inches. The angle of divergence of injection tubes 38 is 60 degrees. The diameter of axial bores 42 is 1/5 inch. Injection tubes 38 project a distance of 1.5 inches from $\frac{3}{8}$-inch-diameter bores in the face of spherical projection 34, as measured from said face to the ends of the injection tubes, being countersunk into solid bores through sperical projection 34 and into the flat end of the bullet opposite its point a distance of 0.23 inch.

Acid manifold conduit 22 and manifold extension 32 have an outside diameter of $1\frac{1}{8}$ inches, and the axial bore of manifold conduit 22 is $\frac{5}{8}$ inch diameter.

The acid manifold conduit, injection housing, and acid injection tubes are fabricated from Hastelloy B-2 corrosion-inhibiting alloy to minimize corrosion, and the injection nozzle assembly is mounted within the 10-inch-diameter conduit so that the ends of injection tubes 38 form a 3-1/5-inch square in a plane vertical to the axis of the brine conduit, the ends being about 2.80 inches from the closest point on the inside surface of the 10-inch-diameter brine conduit as measured along the plane.

The velocity of fluid within the brine conduit is 4 feet per second, and the velocity of acid leaving from the ends of injection tubes 38 is 20 feet per second so that the acid exits the ends of injection tubes 38 at a velocity 5 times that of the fluid in conduit 30.

Although the invention has been described in conjunction with specific embodiments thereof, it is evident that many alternatives, modifications, and variations will be apparent to those skilled in the art in light of the foregoing description. One such pertains to the suspension of the hydrofoil 26 with manifold conduit 22 and extension 32. As shown in the drawing, the axis of manifold conduit 22 and the axis of extension 32 are the same, and this axis (axis 60) is along a diameter of conduit 30 which intersects axis 50 perpendicularly. In a modification encompassed by the present invention, the manifold conduit 22 and extension 32 have different axes which intersect axis 50 of the hydrofoil at any desired angle, with the angle of intersection usually but not necessarily being the same for the manifold conduit as for the extension. In yet another modification, the extension 32 is deleted altogether, using only the strength of manifold conduit 22 to hold the hydrofoil in place. In still another embodiment, the extension 32 is present, but neither its axis nor that of the manifold conduit 22 intersects axis 50. And in still one more embodiment, only one of the axes of manifold conduit 22 and extension 32 intersects axis 50.

Still other embodiments are encompassed within the invention. For example, although the drawing shows injection tubes 38 as straight tubes, it should be apparent that in one modification of the invention these tubes may be curved or even of irregular shape, so long as the ends of the tubes terminate downstream from the injection housing and are spaced from each other so that corrosion is minimized. In one embodiment of this modification, the injection tubes are curved or of irregular shape, but terminate in ends which, as in the preferred embodiment, form a square or rectangle on a plane normal to the axis of the conduit, with the center of the square or rectangle being coincident with the axis of conduit 30. Accordingly, it is intended to embrace all such alternatives, modifications, and variations as fall within the spirit and broad scope of the appended claims.

We claim:

1. An injection nozzle useful for injecting a corrosive fluid into a fluid stream, comprising:

(1) a hydrofoil injection housing having a relatively paraboloid portion at one end;

(2) a tubular manifold conduit for delivering corrosive fluid into said injection housing, said tubular manifold conduit being connected thereto in fluid-tight arrangement; and (3) a plurality of injection tubes which extend from said hydrofoil through the end of said injection housing opposite the vertex of the paraboloid, said injection tubes each having an axial bore which connects in fluid-tight arrangement with the interior of said housing and in fluid communication therewith.

2. An injection nozzle as defined in claim 1 wherein said manifold conduit and housing are connected in a manner such that the axis of the conduit and the axis of the paraboloid intersect at right angles.

3. An injection nozzle as defined in claim 2 wherein each of said injection tubes extends radially from a point on the axis of said paraboloid.

4. An injection nozzle as defined in claim 3 wherein the axes of said injection tubes lie on the surface of an imaginary right circular cone with said point on the axis of said paraboloid as the apex.

5. An injection nozzle as defined in claim 4 wherein said point is the intersection of the axis of the paraboloid and the axis of the manifold conduit.

6. An injection nozzle as defined in claim 5 wherein the injection tubes form an angle of divergence between 20 and 120 degrees.

7. An injection nozzle as defined in claim 5 wherein the injection tubes form an angle of divergence between 35 and 70 degrees.

8. An injection nozzle as defined in claim 1 wherein the ends of the injection tubes form a square centered about the same axis as the paraboloid and on a plane normal to said hydrofoil axis.

9. An injection nozzle as defined in claim 1 wherein said injection housing is comprised of a cylindrical portion, a truncated spherical portion attached on one end of said cylindrical portion, and said relatively paraboloid portion attached on the other end.

10. An injection nozzle as defined in claim 1 wherein said housing is comprised of a cylindrical portion, a first projection attached to one end of said cylindrical portion, said first projection having the shape of a sphere cut by a plane, with the diameter of the circle formed on said plane being equal to that of the cylindrical portion, and a second, parabolic projection at the other end of the cylindrical portion forming the vertex of the paraboloid.

11. An injection nozzle as defined in claim 10 wherein the injection tubes pass through said first projection.

12. An injection nozzle as defined in claim 11 wherein the radius of the spherical surface of said first projection is twice that of the cylindrical portion.

13. An injection nozzle as defined in claim 1 wherein the ends of said injection tubes lie in a plane parallel to the axis of the paraboloid but normal to the axis of the manifold conduit.

14. A nozzle as defined in claim 1 wherein the ends of said injection tubes lie in the same plane and are symmetrical about a point in said plane.

15. A nozzle as defined in claim 1, 4, 8, 9, 11, 7 or 14 wherein the axis of said manifold conduit is perpendicular to that of the paraboloid, and intersects therewith, with said axis of the manifold conduit lying in a plane in which said paraboloid portion terminates.

16. A nozzle as defined in claim 15 wherein the axis of each of the injection tubes extends radially from the intersection of the manifold conduit axis and that of the paraboloid.

17. A nozzle as defined in claim 1, 4, 8, 9, 11, 7, or 16 wherein the axis of the paraboloid portion and the axis of each of said injection tubes intersect at a common point, with a plane perpendicular to said axis of the paraboloid portion through said common point terminating said paraboloid portion.

18. A mixing apparatus comprising:

(1) a cylindrical conduit for carrying a liquid; and (2) a nozzle within the conduit comprising:

(a) a hydrofoil injection housing having a relatively paraboloid portion at one end;

(b) a tubular manifold conduit for delivering a corrosive fluid into said injection housing, said tubular manifold conduit being connected to said housing in fluid-tight arrangement; and (c) a plurality of injection tubes which extend from said hydrofoil through the end of said injection housing opposite the vertex of the paraboloid, said injection tubes each having an axial bore which connects in fluid-tight arrangement with the interior of said housing and in fluid communication therewith.

19. A mixing apparatus as defined in claim 18 wherein the ends of said injection tubes lie in the same plane normal to the axis of said conduit.

20. A mixing apparatus as defined in claim 19 wherein the ends of said injection tubes are symmetrical about the axis of said conduit.

21. A method for injecting a first fluid into a second comprising introducing said first liquid into an injection housing having a relatively paraboloid portion at one end, and delivering said first fluid into said second liquid from said injection housing via a plurality of injection tubes directed radially from a point within said injection housing, said tubes all being directed away from the vertex of said paraboloid portion of the injection housing.

22. An injection nozzle useful for injecting a corrosive fluid into a fluid stream, said nozzle comprising:

(1) a hydrofoil injection housing having a relatively paraboloid portion at one end;

(2) a tubular manifold for delivering the corrosive fluid into said injection housing, said tubular manifold conduit being connected thereto in fluid-tight arrangement;

(3) a plurality of tube means each having an axial bore which connects in fluid-tight arrangement with the interior of said housing and in fluid communication therewith for evenly distributing the flow of said corrosive fluid from the ends of said tube means at a distance from said housing.

23. An injection nozzle as defined in claim 22 wherein said manifold conduit and housing are connected in a manner such that the axis of the conduit and of the paraboloid intersect at right angles.

24. An injection nozzle as defined in claim 23 wherein each of said tube means extends radially from a point on the axis of said paraboloid.

25. An injection nozzle as defined in claim 24 wherein the axes of said tube means lie on the surface of an imaginary right circular cone with said point on the axis of said paraboloid as the apex.

26. An injection nozzle as defined in claim 24 wherein the ends of said tube means form a square centered about the same axis as the paraboloid and on a plane normal to the axis of said paraboloid.

27. A nozzle as defined in claim 22, 25 or 26 wherein the axis of the manifold conduit is perpendicular to that of the paraboloid and intersects therewith, with the axis of the manifold conduit lying in a plane in which the paraboloid portion terminates.

28. A nozzle as defined in claim 27 wherein the axis of each of said tube means extends radially from the intersection of the manifold conduit axis and that of the paraboloid.

29. A nozzle as defined in claim 22, 25, or 26 wherein the axis of the paraboloid portion and the axis of each of said injection tubes intersect at a common point, with a plane perpendicular to the axis of the paraboloid portion through the common point terminating the paraboloid portion.

* * * * *